US007849973B2

(12) United States Patent
Hikita et al.

(10) Patent No.: US 7,849,973 B2
(45) Date of Patent: Dec. 14, 2010

(54) REFUGE SUPPORT SYSTEM OF DOUBLE DECK ELEVATOR

(75) Inventors: Shiro Hikita, Tokyo (JP); Kiyoji Kawai, Tokyo (JP); Masahiko Konishi, Tokyo (JP); Masafumi Iwata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/677,124

(22) PCT Filed: Oct. 26, 2007

(86) PCT No.: PCT/JP2007/070908

§ 371 (c)(1),
(2), (4) Date: Mar. 9, 2010

(87) PCT Pub. No.: WO2009/054065

PCT Pub. Date: Apr. 30, 2009

(65) Prior Publication Data

US 2010/0200336 A1 Aug. 12, 2010

(51) Int. Cl.
*B66B 1/20* (2006.01)

(52) U.S. Cl. ..... 187/384; 187/902; 187/392; 187/393

(58) Field of Classification Search ..... 187/247, 187/277, 313, 380–388, 391–393, 902
See application file for complete search history.

(56) References Cited

U.S. PATENT DOCUMENTS 5,551,533 A * 9/1996 Ng ..... 187/391
5,660,249 A * 8/1997 Powell et al. ..... 187/249
7,377,365 B2 * 5/2008 Abe et al. ..... 187/396
7,487,860 B2 * 2/2009 Hikita et al. ..... 187/249
7,537,089 B2 * 5/2009 Duenser et al. ..... 187/249
7,588,126 B2 * 9/2009 Siikonen et al. ..... 187/384
7,594,564 B2 * 9/2009 Siikonen et al. ..... 187/384
7,621,378 B2 * 11/2009 Kawai ..... 187/313
7,677,363 B2 * 3/2010 Kawai ..... 187/387
7,743,889 B2 * 6/2010 Kawai ..... 187/313
2008/0196978 A1 * 8/2008 Siikonen et al. ..... 187/384

(Continued)

FOREIGN PATENT DOCUMENTS

JP 5 8954 1/1993

(Continued)

*Primary Examiner*—Jonathan Salata
(74) *Attorney, Agent, or Firm*—Oblon, Spivak, McClelland, Maier & Neustadt, L.L.P.

(57) ABSTRACT

An evacuation support system for a double-deck elevator allows people stranded in a building to evacuate to an evacuation floor upon an occurrence of a fire in the building including a plurality of floors. The evacuation support system includes an evacuation support apparatus including a rescue floor setting mechanism, and a double-deck elevator including a connected car including an upper car and a lower car which are vertically connected to each other. The rescue floor setting mechanism determines two adjacent floors among respective floors satisfying a predetermined condition as candidate rescue floors and sets, based on a floor on which the fire occurs, at least any one of the candidate rescue floors as the rescue floor. The double deck elevator performs an evacuation operation for moving the connected car in a reciprocating manner between the rescue floor and the evacuation floor based on a command from the evacuation support apparatus.

9 Claims, 3 Drawing Sheets

U.S. PATENT DOCUMENTS

2008/0202861 A1* 8/2008 Kawai ..... 187/384

FOREIGN PATENT DOCUMENTS

JP 5 147849 6/1993
JP 2005 225604 8/2005
WO 2007 080636 7/2007
WO 2007 096969 8/2007

* cited by examiner

REFUGE SUPPORT SYSTEM OF DOUBLE DECK ELEVATOR

TECHNICAL FIELD

The present invention relates to an evacuation support system for a double-deck elevator, which serves to evacuate people stranded in a building to an evacuation floor when a fire occurs in the building.

BACKGROUND ART

Conventionally, there has been proposed a system of operating elevators which is designed to perform control operation individually for each of a plurality of elevator groups to stop cars at nearest floors when a fire occurs in a building in which the plurality of elevator groups are installed. An order of priority for starting control operation is set for each of the elevator groups based on a fire occurrence floor. This control operation is started for the elevator groups in the order of the priorities set in advance. Thus, the duration of normal operation of those of the elevator groups which are not significantly influenced by the fire can be extended (see Patent Document 1).

Further, conventionally, there has been also proposed a control apparatus for an elevator which guides a car to a floor other than a fire occurrence floor in the event of a fire (see Patent Document 2).

Patent Document 1: JP 05-8954 A

Patent Document 2: JP 05-147849 A

DISCLOSURE OF THE INVENTION

Problem to be solved by the Invention

However, in the system of operating the elevators disclosed in Patent Document 1, the duration of normal operation of only one or some of the elevator groups can be extended. After the cars have been stopped through control operation, people in the building cannot be conveyed to an evacuation floor. As a result, the efficiency in conveying people in the building in the event of a fire decreases.

In the control apparatus for the elevator disclosed in Patent Document 2 as well, the car is stopped at a nearest floor through control operation in the event of the fire, and hence the efficiency in conveying people in the building in the event of the fire decreases.

The present invention has been made to solve the above-mentioned problem, and it is therefore an object of the present invention to provide an evacuation support apparatus for a double-deck elevator which may improve the efficiency in conveying people in the building to the evacuation floor.

Means for Solving the Problems

According to the present invention, provided is an evacuation support system for a double-deck elevator, for allowing people stranded in a building including a plurality of floors to evacuate to an evacuation floor in an event of a fire in the building, including: an evacuation support apparatus including rescue floor setting means capable of selecting upper and lower floors which are adjacent to each other and satisfy a predetermined condition from the floors as upper and lower candidate rescue floors and of setting at least any one of the candidate rescue floors as a rescue floor based on the floor on which the fire occurs; and a double-deck elevator including a connected car including an upper car and a lower car which are vertically connected to each other, the double-deck elevator being for performing an evacuation operation for moving the connected car in a reciprocating manner between the rescue floor and the evacuation floor based on a command from the evacuation support apparatus, in which the double-deck elevator stops at least any one of the upper car and the lower car at the rescue floor to allow the people to get on and off in a case of the evacuation operation and then stops the car selected from the upper car and the lower car, which has been stopped at the rescue floor to allow the people to get on and off, at the evacuation floor to allow the people to get on and off.

BEST MODE FOR CARRYING OUT THE INVENTION

A preferred embodiment of the present invention is described hereinafter with reference to the drawings.

First Embodiment

Figure 1:
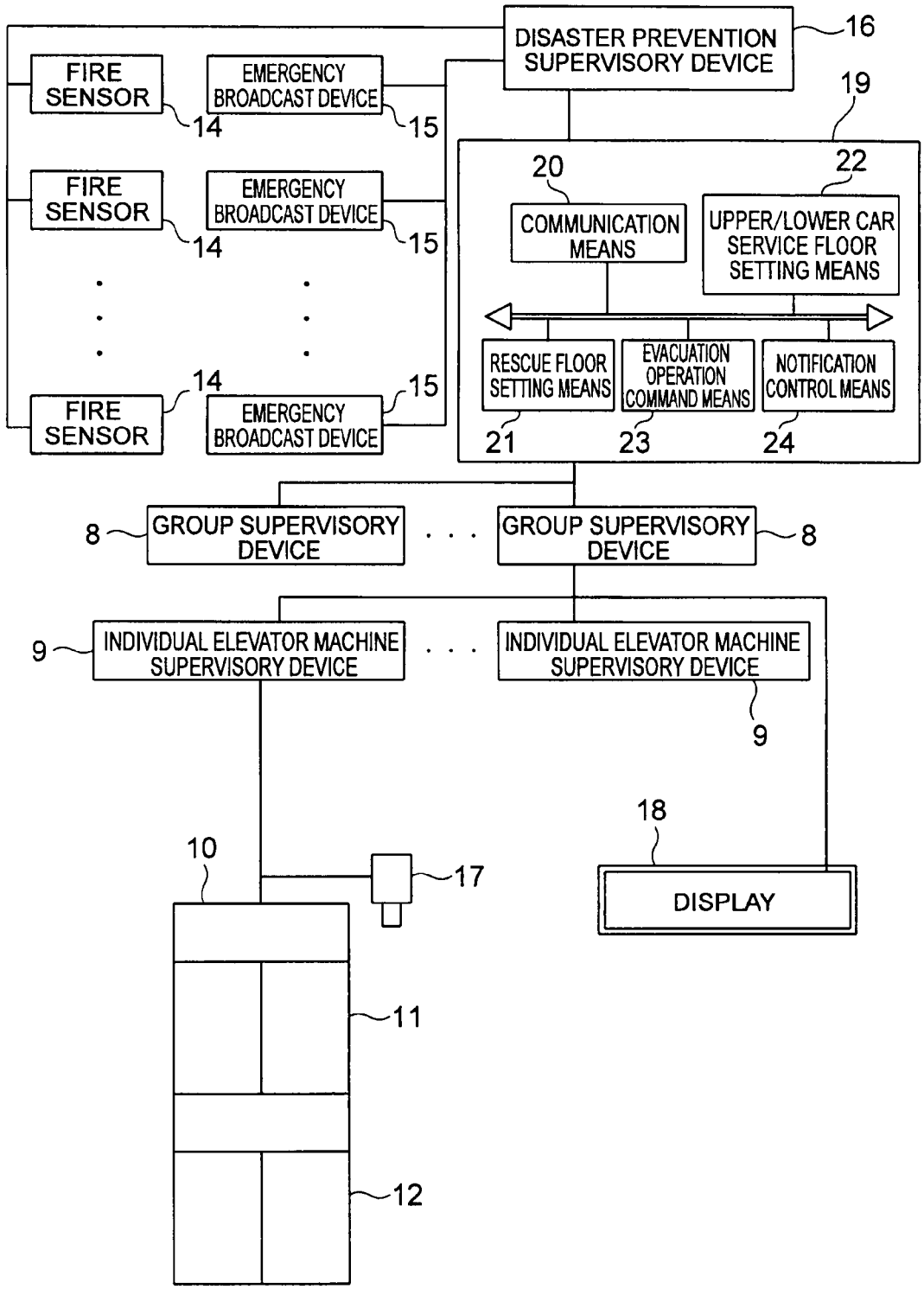
FIG. 1 is a block diagram illustrating an evacuation support system for a double-deck elevator according to a first embodiment of the present invention.
Figure 2:
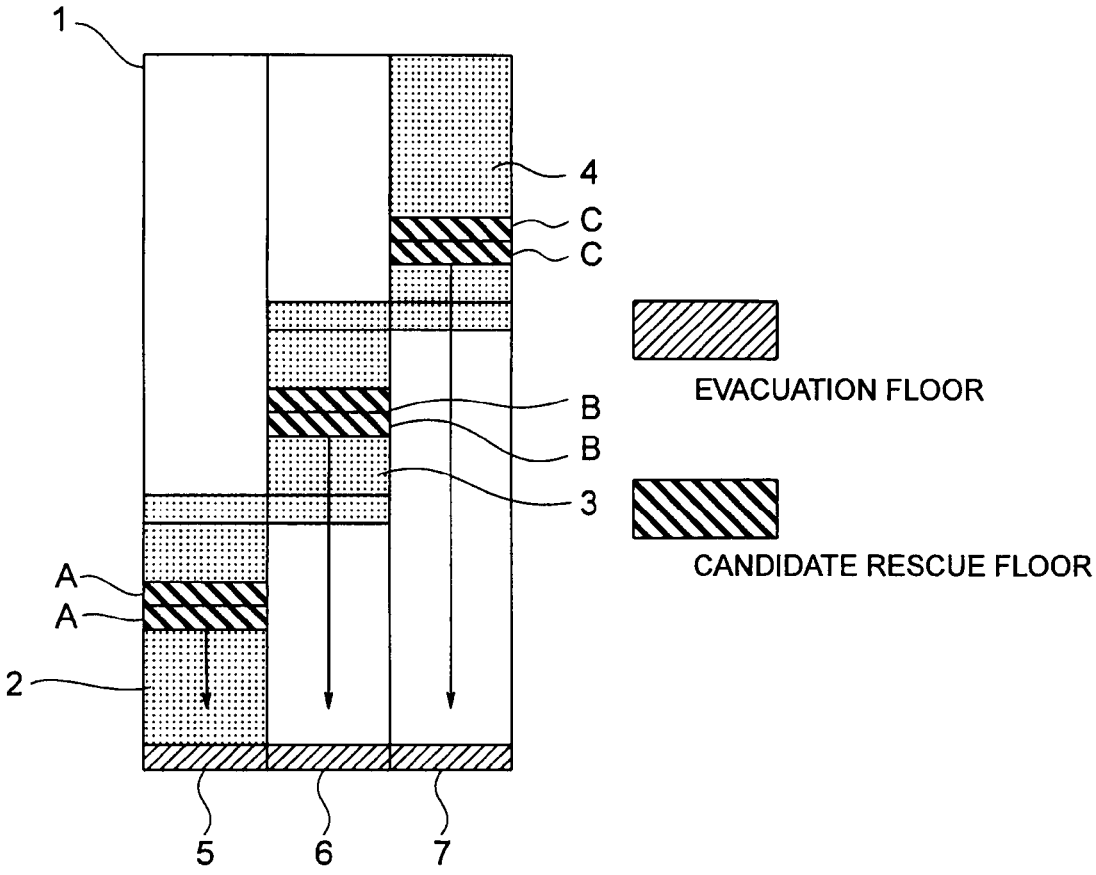
FIG. 2 is a schematic view illustrating a building provided with elevators illustrated in FIG. 1.

FIG. 1 is a block diagram illustrating an evacuation support system for an elevator according to a first embodiment of the present invention. FIG. 2 is a schematic view illustrating a building provided with elevators illustrated in FIG. 1. In the drawing, a building 1 including a plurality of floors is provided with a low-layer service zone 2, an intermediate-layer service zone 3, and a high-layer service zone 4 (FIG. 2). Each of the service zones 2 to 4 includes a plurality of floors so that the floors included in each of the service zones 2 to 4 at least partially differ from those of each of the other two service zones. The building 1 is also provided with a common evacuation floor that is not included in any one of the service zones 2 to 4. In this example, the evacuation floor is the lowest floor in the building 1, that is, a first floor (entrance floor).

In addition, the building 1 is provided with an elevator 5 on a low-layer bank which is assigned to the floors included in the low-layer service zone 2 as service floors, an elevator 6 on an intermediate-layer bank which is assigned to the floors included in the intermediate-layer service zone 3 as service floors, and an elevator 7 on a high-layer bank which is assigned to the floors included in the high-layer service zone 4 as service floors. That is, the building 1 is provided with the individual elevators 5 to 7 which are assigned to the floors included in the service zones 2 to 4, respectively, as service floors.

Each of the elevators 5 to 7 on the respective banks has a plurality of elevator machines (not shown). Each of the elevators 5 to 7 on the respective banks is provided with a group supervisory device 8 for supervising the operations of the elevator machines as a group, as illustrated in FIG. 1. Each elevator machine is provided with an individual elevator machine supervisory device 9 for controlling the operation of the elevator machine under the supervision of the group supervisory device 8.

Each of the elevator machines includes a connected car 10 which is capable of conveying passengers. The connected car 10 includes an upper car 11 and a lower car 12 which are vertically connected. Specifically, each of the elevators 5 to 7 on the respective banks is constituted as a double-deck elevator for conveying the passengers with the connected car 10. The upper car 11 and the lower car 12 are allowed to stop simultaneously at upper and lower floors which are adjacent to each other.

The upper car 11 and the lower car 12 in the elevator 5 on the low-layer bank are allowed to stop at the service floors in the low-layer service zone 2. The upper car 11 and the lower car 12 in the elevator 6 on the intermediate-layer bank are allowed to stop at the service floors in the intermediate-layer service zone 3. The upper car 11 and the lower car 12 in the elevator 7 on the high-layer bank are allowed to stop at the service floors in the high-layer service zone 4. Further, the upper car 11 and the lower car 12 are allowed to stop even at the evacuation floor.

Moreover, the building 1 is provided with emergency stairs (not shown) which are used by people stranded in the building 1 to move between the floors (to go up and down). Each of the floors is divided into an elevator area in which a corresponding one of the elevators 5 to 7 is provided, and a stair area in which the emergency stairs are provided (neither of them shown).

Further, each of the floors is provided with a fire sensor 14 for sensing the occurrence of a fire and an emergency broadcast device 15 for broadcasting an announcement relating to the occurrence of the fire throughout the building 1.

Information from each of the fire sensors 14 is transmitted to a disaster prevention supervisory device 16 for supervising disaster prevention components in the entire building 1 comprehensively. The disaster prevention supervisory device 16 detects whether or not a fire has occurred and identifies a fire occurrence floor based on the information from each of the fire sensors 14.

A congestion-degree detection sensor 17 for detecting whether or not there is congestion in the elevator area is provided in the elevator area of each of the floors. In this example, the congestion-degree detection sensor 17 is a photographic device (camera) capable of photographing a predetermined range of the elevator area.

An evacuation-information notification device 18 for notification of evacuation information relating to evacuation of the people in the building is provided between the elevator area and the stair area on each of the floors. In this example, the evacuation-information notification device 18 is a display for displaying the evacuation information. The evacuation information displayed on the display includes information indicating whether or not a ride on the connected car 10 is possible at a landing where the display is provided (ride possibility information) and information for guiding the people in the building for the evacuation (evacuation guide information).

Information from the disaster prevention supervisory device 16 and information from the congestion-degree detection sensor 17 are transmitted to an evacuation support apparatus 19 for supervising each of the group supervisory devices 8 in the event of a fire. The disaster prevention supervisory device 16 and the evacuation support apparatus 19 are provided in a control room (disaster prevention center) for monitoring and controlling equipment for disaster prevention in a centralized manner.

After the detection of the occurrence of the fire by the disaster prevention supervisory device 16, the evacuation support apparatus 19 supervises the group supervisory devices 8 comprehensively to cause each of the elevators 5 to 7 to perform an evacuation operation for conveying the people stranded in the building 1 to the evacuation floor. Moreover, the evacuation support apparatus 19 detects whether or not there is congestion in the elevator area based on the information from the congestion-degree detection sensor 17.

Whether or not there is congestion in the elevator area is detected by comparing an occupancy of the people in the photographed range covered by the congestion-degree detection sensor 17 and a preset threshold value with each other. Specifically, it is detected that there is congestion in the elevator area when the occupancy of the people in the photographed range exceeds the threshold value, whereas it is detected that the congestion in the elevator area is avoided when the occupancy of the people in the photographed range is equal to or less than the threshold value. The occupancy of the people in the photographed range is obtained by image processing of the information from the congestion-degree detection sensor 17.

The evacuation support apparatus 19 includes communication means 20, rescue floor setting means 21, upper/lower car service floor setting means 22, evacuation operation command means 23, and notification control means 24.

The communication means 20 allows each of the group supervisory devices 8 and the disaster prevention supervisory device 16 to exchange information with the evacuation support apparatus 19.

The rescue floor setting means 21 selects upper and lower floors, which are adjacent to each other and satisfy predetermined conditions, from the floors as candidate rescue floors to set at least any one of the candidate rescue floors as a rescue floor based on the floor on which a fire occurs (fire occurrence floor). In this example, the candidate rescue floors are predetermined based on a shape of the building 1.

Among the service floors included in the respective service zones 2 to 4, the rescue floor setting means 21 select upper and lower first candidate rescue floors A for the low-layer service zone 2, upper and lower second candidate rescue floors B for the intermediate-layer service zone 3, and upper and lower third candidate rescue floors C for the high-layer service zone 4 (FIG. 2).

The candidate rescue floors are selected by vertically separating the building 1 into a plurality of (four in this example) separate zones and then setting, among each of the separate zones, the lowest floor in each of the separate zones except for the lowest separate zone and a floor which is situated above the lowest floor to be adjacent thereto as each of sets of candidate rescue floors A to C. The number of the separate zones is larger than the number of the respective service zones 2 to 4 by one. Specifically, in the building 1 provided with the elevators on the N banks, the candidate rescue floors are selected by separating the building 1 into (N+1) separate zones and then setting, among each of the separate zones, the lowest floor in the N separate zones other than the lowest separate zone and the floor which is situated above the lowest floor to be adjacent thereto as the upper and lower candidate rescue floors. Specifically, the upper and lower candidate rescue floors satisfy a condition of being the lowest floor in each of the separate zones and a condition of being a floor situated above the lowest floor in the corresponding separate zone (predetermined conditions).

The rescue floor is set by judging whether or not the people can get on and off the connected car 10 for each of the candidate rescue floors based on the information from the disaster prevention supervisory device 16. Specifically, only the floor on which the people can get on and off the connected car 10 because the floor has not been affected by the fire yet is selected from the candidate rescue floors to be set as the rescue floor. Therefore, the floor on which the people cannot get on and off the connected car 10 due to the fire is not set as the rescue floor even if the floor is one of the candidate rescue floors.

The people in each of the separate zones move to a corresponding one of the rescue floors located below or the evacuation floor for evacuation.

Each of the candidate rescue floors A to C is set so that the people in each of the separate zones cover the same distance in moving to a corresponding one of the rescue floors or to the evacuation floor by taking stairs. Each of the candidate rescue floors A to C may be set so that the sum of a time required for the people in the building to move by taking the stairs and a conveyance time for conveying the people in the building from each of the rescue floors to the evacuation floor becomes the same for the rescue floors.

The upper/lower car service floor setting means 22 sets the service floors for each of the upper cars 11 and the lower cars 12 of each of the elevators 5 to 7 based on information from the rescue floor setting means 21. Specifically, the upper/lower car service floor setting means 22 determines for each of the upper cars 11 and the lower cars 12 whether or not to stop the car at the rescue floor(s) set by the rescue floor setting means 21 to allow the people to get on and off (whether or not the rescue floor is to be serviced).

In this example, when the upper and lower candidate rescue floors which are adjacent to each other are both set as the rescue floors, the upper/lower car service floor setting means 22 sets the upper rescue floor as the service floor to be serviced exclusively by the upper car 11 and the lower rescue floor as the service floor to be serviced exclusively by the lower car 12 so as to prevent the upper car 11 from being stopped at the lower rescue floor or the lower car 12 from being stopped at the upper rescue floor. Moreover, when only any one of the upper and lower candidate rescue floors which are adjacent to each other is set as the rescue floor, the upper/lower car service floor setting means 22 sets the rescue floor as the service floor to be serviced by both the upper car 11 and the lower car 12 so that both the upper car 11 and the lower car 12 are stopped at the rescue floor to allow the people to get on and off.

The evacuation operation command means 23 transmits an evacuation operation command for causing the elevators 5 to 7 on the respective banks to perform the evacuation operation to each of the group supervisory devices 8. After the rescue floor setting means 19 receives information of determination of occurrence of the fire in the building 1 from the disaster prevention supervisory device 16, the evacuation operation command means 23 outputs the evacuation operation command.

Upon reception of the information of the determination of the occurrence of the fire from the disaster prevention supervisory device 16 through the evacuation support apparatus 19, each of the elevators 5 to 7 performs a control operation in the event of a fire. The control operation in the event of a fire is an operation for stopping the connected cars 10 at the nearest floors. Moreover, in response to the evacuation operation command from the evacuation support apparatus 19, each of the elevators 5 to 7 performs the evacuation operation. The evacuation operation is an operation for moving the connected cars 10 between the rescue floors set by the rescue floor setting means 21 and the preset evacuation floor (entrance floor) in a reciprocating manner.

In the case of the evacuation operation, each of the elevators 5 to 7 controls the position of each of the connected cars 10 at the arrival at the rescue floor(s) based on information from the evacuation floor setting means 21. Specifically, when the upper and lower candidate rescue floors which are adjacent to each other are both set as the rescue floors, each of the elevators 5 to 7 in the case of the evacuation operation controls the position of each of the connected cars 10 at the arrival at the rescue floors so that the upper car 11 is stopped at the upper rescue floor to allow the people to get on and off and the lower car 12 is stopped at the lower rescue floor to allow the people to get on and off. Moreover, when only any one of the upper and lower candidate rescue floors which are adjacent to each other is set as the rescue floor, each of the elevators 5 to 7 in the case of the evacuation operation controls the position of each of the connected cars 10 at the arrival at the rescue floor so that the lower car 12 and the upper car 11 are stopped at the rescue floor in the stated order to allow the people to get on and off.

Each of the elevators 5 to 7 in the case of the evacuation operation stops the car (s) selected from the upper car 11 and the lower car 12, which has/have been stopped at the rescue floor(s) to allow the people to get on and off, at the evacuation floor to allow the people to get on and off when the connected car 10 arrives at the evacuation floor. The upper car 11 and the lower car 12 are both stopped at the rescue floors in this example, and hence each of the upper car 11 and the lower car 12 is stopped at the evacuation floor to allow the people to get on and off. Moreover, each of the elevators 5 to 7 in the case of the evacuation operation controls the position of the connected car 10 at the arrival at the evacuation floor so that the lower car 12 and the upper car 11 are stopped at the evacuation floor in the stated order to allow the people to get on and off.

The notification control means 24 controls the display of the evacuation information by the evacuation-information notification device 18 based on the information from each of the congestion-degree detection sensor 17 and the rescue floor setting means 21. Specifically, the notification control means 24 controls the display of the ride possibility information based on the information from the rescue floor setting means 21 and controls the display of the evacuation guidance information based on the information indicating whether or not there is congestion on the rescue floor, which is detected based on the information from the congestion-degree detection sensor 17. As a result, the evacuation information notification device 18 displays the evacuation information according to the information from each of the congestion-degree detection sensor 17 and the rescue floor setting means 21.

The evacuation support apparatus 19 includes a computer including a calculation processing portion (CPU), a storage portion (ROM, RAM, or the like), and signal input/output portions. The functions of the communication means 20, the rescue floor setting means 21, the upper/lower car service floor setting means 22, the evacuation operation command means 23, and the notification control means 24 are realized by the computer constituting the evacuation support apparatus 19.

That is, programs for realizing the functions of the communication means 20, the rescue floor setting means 21, the upper/lower car service floor setting means 22, the evacuation operation command means 23, and the notification control means 24 are stored in the storage portion of the computer. Information such as predetermined conditions to determine each of the candidate rescue floors A to C or the like is also stored in the storage portion. The calculation processing portion performs a calculation processing regarding the function of the evacuation support apparatus 19 based on the programs stored in the storage portion.

Next, an operation is described. Upon determination of the occurrence of the fire by the disaster prevention supervisory device 16, the information of the determination of the occurrence of the fire is transmitted from the disaster prevention supervisory device 16 to the evacuation support apparatus 19 and each of the group supervisory devices 8. As a result, the operation of each of the elevators 5 to 7 is switched to the control operation in the event of a fire. The moving connected cars 10 are stopped at the nearest floors to wait in a door-open state.

Upon reception of the information of the determination of the occurrence of the fire by the evacuation support apparatus 19, each of the rescue floors is set by the rescue floor setting means 21 based on the fire occurrence floor.

After that, the evacuation operation command is output from the evacuation support apparatus 19 to each of the group supervisory devices 8. As a result, the evacuation operation for each of the elevators 5 to 7 is performed under the supervision of the group supervisory devices 8.

Figure 3:
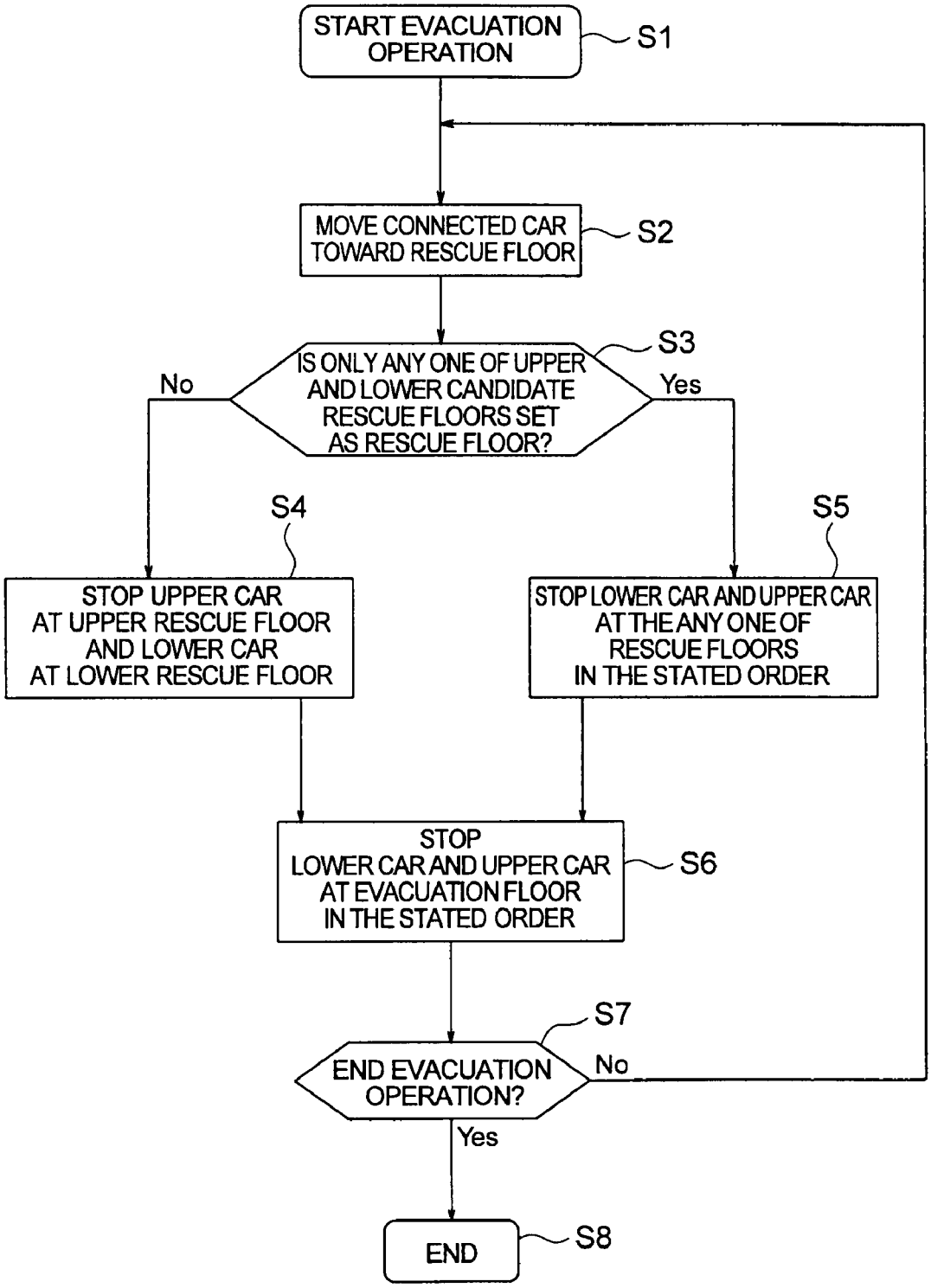
FIG. 3 is a flowchart for describing an operation after a start of an evacuation operation by the evacuation support system illustrated in FIG. 1.

FIG. 3 is a flowchart for describing an operation after the start of the evacuation operation by the evacuation support system illustrated in FIG. 1. As illustrated in the drawing, upon start of the evacuation operation of each of the elevators 5 to 7 (S1), each of the connected cars 10 is moved toward the rescue floor(s) (S2).

After that, in each of the elevators 5 to 7, whether or not the floor set as the rescue floor by the rescue floor setting means 21 is only any one of the upper and lower candidate rescue floors which are adjacent to each other (S3).

When not any one of the upper and lower candidate rescue floors but both the upper and lower candidate rescue floors are set as the rescue floors, the upper car 11 is stopped at the upper one of the rescue floors to allow the people to get on and off, whereas the lower car 12 is stopped at the lower one of the rescue floors to allow the people to get on and off (S4). As a result, the people present on the upper rescue floor get on the upper car 11, whereas the people present on the lower rescue floor get on the lower car 12.

When only any one of the upper and lower candidate rescue floors is set as the rescue floor, the lower car 12 and the upper car 11 are stopped at only the any one of the rescue floors in the stated order to allow the people to get on and off (S5). As a result, the people present on the common rescue floor separately get on the upper car 11 and the lower car 12.

After that, the connected car 10 is moved toward the evacuation floor. When the connected car 10 arrives at the evacuation floor, the lower car 12 and the upper car 11 are stopped at the evacuation floor in the stated order to allow the people to get on and off (S6). As a result, the people who are in the upper car 11 and the lower car 12 get off the cars at the common evacuation floor.

In the manner described above, the people present on the rescue floors are conveyed to the evacuation floor by the movement of the connected car 10 in the case of the evacuation operation.

In the case of the evacuation operation, the broadcast in the building is performed by each of the emergency broadcast devices 15 under the supervision of the evacuation support apparatus 19. The contents of the broadcast in the building include a content indicating the possibility of the evacuation by the evacuation operation of each of the elevators 5 to 7 and a content identifying the rescue floor on which the people can get on and off the connected car 10 when the evacuation by the evacuation operation is possible.

Moreover, in the case of the evacuation operation, the evacuation information containing the ride possibility information and the evacuation guidance information is displayed on the evacuation-information notification device 18 by the control of the notification control means 24. For example, when the upper and lower candidate rescue floors which are adjacent to each other are both set as the rescue floors, there are some cases where only one of the rescue floors is crowded with the people and the congestion on the other rescue floor is avoided. In such cases, on the evacuation-information notification device 18 provided on the rescue floor which is crowded with the people, a message such as "The elevator landing on this floor is now very crowded. Please move to the XX-th floor." is displayed as the evacuation guidance information. In this manner, the people are guided to the other rescue floor on which the congestion is avoided.

After that, the evacuation support apparatus 19 judges whether or not a termination condition of the evacuation operation is satisfied (S7). It is determined that the termination condition of the evacuation operation is satisfied, for example, when a termination button installed in each of the elevators 5 to 7 is operated, when an abnormality detecting sensor installed in each of the elevators 5 to 7 is actuated due to the spread of the fire, the inundation resulting from fire fighting, or the like, or when the absence of people getting on the connected cars 10 at each of the rescue floors is detected by a boarding/disembarkation sensor or the like. That is, the termination condition of the evacuation operation is satisfied when the continuation of the evacuation operation becomes difficult or when a condition for completing the evacuation operation is satisfied.

When the termination condition is not satisfied, the evacuation operation of each of the elevators 5 to 7 is continued (S2). In this case, the broadcasting in the building by each of the emergency broadcast devices 15 and the display of the evacuation information by the evacuation-information notification device 18 are also continued. When the termination condition is satisfied, the evacuation operation of each of the elevators 5 to 7 is terminated in response to a termination command from the evacuation support apparatus 19 to the group supervisory devices 8 (S8).

In the evacuation support system for the double-deck elevator as described above, each of the elevators 5 to 7 is constituted as the double-deck elevator including the connected cars 10. In the event of the fire, each of the elevators 5 to 7 is caused to perform the evacuation operation for moving the connected cars 10 in a reciprocating manner between the rescue floor(s) and the evacuation floor. In each of the elevators 5 to 7 during the evacuation operation, each of the upper car 11 and the lower car 12 of the connected car 10 is stopped at the rescue floor(s) to allow the people to get on and off . Therefore, the number of people who are loaded in the connected car 10 at a time can be increased, and hence a larger number of people can be conveyed to the evacuation floor. Thus, the evacuation of the people in the building can be completed within a shorter period of time, and hence the efficiency in conveying the people in the building to the evacuation floor can be improved.

Moreover, when the upper and lower candidate rescue floors which are adjacent to each other are both set as the rescue floors, the upper car 11 and the lower car 12 are simultaneously stopped at the respective rescue floors to allow the people to get on and off. Therefore, only one stop of the connected car 10 allows the people in the building to get on both the upper car 11 and the lower car 12. Thus, the boarding of the people in the building on the connected car 10 can be completed within a shorter period of time. As a result, the efficiency in conveying the people in the building to the evacuation floor can be further improved.

Moreover, when only any one of the upper and lower candidate rescue floors which are adjacent to each other is set as the rescue floor, the lower car 12 and the upper car 11 are stopped at the rescue floor in the stated order to allow the people to get on and off. Therefore, even when only one rescue floor can be set because of the fire, the people in the building are allowed to get on each of the upper car 11 and the lower car 12. As a result, the efficiency in conveying the people in the building to the evacuation floor can be improved.

Moreover, the lower car 12 and the upper car 11 are stopped at the evacuation floor in the stated order to allow the people to get on and off. Therefore, the people loaded in the different cars, that is, the upper car 11 and the lower car 12, are allowed to get off the cars on the common evacuation floor.

Moreover, the congestion-degree detection sensor 17 for detecting whether or not there is congestion in the landing is provided in the elevator area, and the evacuation-information notification device 18 for displaying the evacuation information for the evacuation of the people in the building is provided between the stair area and the elevator area. The evacuation-information notification device 18 is controlled based on the information from each of the congestion-degree detection sensor 17 and the rescue floor setting means 21. Therefore, the people present in the stair area can be notified of the evacuation information containing the ride possibility information which identifies the rescue floor on which the people can get on the connected car 10, the evacuation guidance information for guiding the people in the building to the rescue floor which is not crowded, and the like. Therefore, the people moving by taking the stairs can be prevented from being panicked. As a result, the people in the building can be quickly guided to each of the rescue floors. In this manner, the efficiency in conveying the people in the building to the evacuation floor can be further improved.

When only any one of the upper and lower candidate rescue floors which are adjacent to each other is set as the rescue floor, the lower car 12 and the upper car 11 are stopped at the rescue floor in the stated order to allow the people to get on and off in the aforementioned example. Alternatively, only any one of the upper car 11 and the lower car 12 may be stopped at the rescue floor to allow the people to get on and off to prevent the other one of the upper car 11 and the lower car 12 from stopping at the rescue floor. In this manner, it is no longer necessary to perform a complicated evacuation operation for stopping each of the upper car 11 and the lower car 12 at the rescue floor. Therefore, the evacuation operation can be performed in the same procedure as that of the operation of a general single-deck elevator (elevator having a single car which is not connected to another one), and hence the control of the evacuation operation can be simplified.

The lowest floor in each of the separate zones except for the lowest separate zone and the floor situated above the lowest floor to be adjacent thereto are set as the upper and lower candidate rescue floors, and at least any one of the upper and lower candidate rescue floors can be set as the rescue floor in the aforementioned example. Alternatively, only the lowest floor in each of the separate zones may be set as the single rescue floor in each of the separate zones except for the lowest separate zone. Specifically, the rescue floor setting means 21 may set not the upper and lower floors which are adjacent to each other but the floor satisfying a condition to be satisfied only by the lowest floor in each of the separate zones except for the lowest separate zone (predetermined condition) as the single rescue floor. Even in this manner, the lower car 12 and the upper car 11 are stopped at the rescue floor in the stated order to allow the people to get on and off. As a result, the people in the building are allowed to get on each of the upper car 11 and the lower car 12. Thus, the efficiency in conveying the people in the building to the evacuation floor can be improved.

The evacuation-information notification device 18 is the display for displaying the evacuation information in the aforementioned example. Alternatively, a speaker for audio notification of the evacuation information may also be used as the evacuation-information notification device.

The invention claimed is:

1. An evacuation support system for a double-deck elevator, for allowing people stranded in a building including a plurality of floors to evacuate to an evacuation floor in an event of a fire in the building, comprising:

an evacuation support apparatus including rescue floor setting means capable of selecting upper and lower floors which are adjacent to each other and satisfy a predetermined condition from the floors as upper and lower candidate rescue floors and of setting at least any one of the candidate rescue floors as a rescue floor based on the floor on which the fire occurs; and a double-deck elevator including a connected car including an upper car and a lower car which are vertically connected to each other, the double-deck elevator being for performing an evacuation operation for moving the connected car in a reciprocating manner between the rescue floor and the evacuation floor based on a command from the evacuation support apparatus, wherein the double-deck elevator stops at least any one of the upper car and the lower car at the rescue floor to allow the people to get on and off in a case of the evacuation operation and then stops the car selected from the upper car and the lower car, which has been stopped at the rescue floor to allow the people to get on and off, at the evacuation floor to allow the people to get on and off.

2. An evacuation support system for a double-deck elevator according to claim 1, wherein, when the upper and lower candidate rescue floors are both set as the rescue floors, the upper car and the lower car are simultaneously stopped at the respective rescue floors to allow the people to get on and off.

3. An evacuation support system for a double-deck elevator according to claim 1, wherein, when only any one of the upper and lower candidate rescue floors is set as the rescue floor, the lower car and the upper car are stopped at the rescue floor in the stated order to allow the people to get on and off.

4. An evacuation support system for a double-deck elevator according to claim 2, wherein the lower car and the upper car are stopped at the evacuation floor in the stated order to allow the people to get on and off.

5. An evacuation support system for a double-deck elevator according to claim 1, wherein, when only any one of the upper and lower candidate rescue floors is set as the rescue floor, only any one of the upper car and the lower car is stopped at the rescue floor to allow the people to get on and off.

6. An evacuation support system for a double-deck elevator, for allowing people stranded in a building including a plurality of floors to evacuate to an evacuation floor in an event of a fire in the building, comprising:

an evacuation support apparatus including rescue floor setting means capable of setting a floor satisfying a predetermined condition from the floors as a single rescue floor; and a double-deck elevator including a connected car including an upper car and a lower car which are vertically connected to each other, the double-deck elevator being for performing an evacuation operation for moving the connected car in a reciprocating manner between the rescue floor and the evacuation floor based on a command from the evacuation support apparatus, wherein the double-deck elevator stops the lower car and the upper car in the stated order at each of the rescue floor and the evacuation floor to allow the people to get on and off in a case of the evacuation operation.

7. An evacuation support system for a double-deck elevator according to claim 1, wherein:

each of the floors is divided into a stair area where stairs for movement between the floors are provided and an elevator area where the double-deck elevator is provided;

each of the floors is further provided with: a congestion-degree detection sensor provided in the elevator area, the congestion-degree detection sensor being for detecting whether or not there is congestion in the elevator area; and an evacuation-information notification device provided between the stair area and the elevator area, the evacuation-information notification device being for notification of evacuation information relating to evacuation of the people in the building; and the evacuation support apparatus further comprises notification control means for causing the evacuation-information notification device to perform the notification of the evacuation information according to information from each of the congestion-degree detection sensor and the rescue floor setting means.

8. An evacuation support system for a double-deck elevator according to claim 3, wherein the lower car and the upper car are stopped at the evacuation floor in the stated order to allow the people to get on and off.

9. An evacuation support system for a double-deck elevator according to claim 6, wherein:

each of the floors is divided into a stair area where stairs for movement between the floors are provided and an elevator area where the double-deck elevator is provided;

each of the floors is further provided with: a congestion-degree detection sensor provided in the elevator area, the congestion-degree detection sensor being for detecting whether or not there is congestion in the elevator area; and an evacuation-information notification device provided between the stair area and the elevator area, the evacuation-information notification device being for notification of evacuation information relating to evacuation of the people in the building; and the evacuation support apparatus further comprises notification control means for causing the evacuation-information notification device to perform the notification of the evacuation information according to information from each of the congestion-degree detection sensor and the rescue floor setting means.

* * * * *